US006322454B1

(12) United States Patent
Gordon

(10) Patent No.: US 6,322,454 B1
(45) Date of Patent: Nov. 27, 2001

(54) INFLATABLE RECREATIONAL DEVICE

(75) Inventor: Donald W. Gordon, Draper, UT (US)

(73) Assignee: Aviva Sports, L.L.C., Montreal, MO (US)

( * ) Notice: Subject to any disclaimer, the term of this patent is extended or adjusted under 35 U.S.C. 154(b) by 0 days.

(21) Appl. No.: 09/483,811

(22) Filed: Jan. 15, 2000

(51) Int. Cl.[7] ..... A63B 31/00
(52) U.S. Cl. ..... 472/134; 472/136; 482/35
(58) Field of Search ..... 472/134, 136, 472/137; 482/35, 37, 52; 446/220; 52/2.11, 2.22, 2.25, 2.26

(56) References Cited

U.S. PATENT DOCUMENTS

| | | | | |
|---|---|---|---|---|
| 3,744,191 | * | 7/1973 | Bird | 52/2.11 |
| 4,802,734 | * | 2/1989 | Walter | 52/2.11 X |
| 5,092,587 | | 3/1992 | Ulner et al. | 272/112 |
| 5,242,652 | | 9/1993 | Savigny | 264/510 |
| 5,254,058 | | 10/1993 | Savigny | 482/37 |
| 5,549,195 | | 8/1996 | Aulagner et al. | 198/850 |
| 5,678,357 | * | 10/1997 | Rubio et al. | 52/2.17 |
| 5,970,661 | * | 10/1999 | Bishop et al. | 52/2.11 |

FOREIGN PATENT DOCUMENTS

| | | |
|---|---|---|
| 2666017 | 2/1992 | (FR) . |
| 2671016 | 7/1992 | (FR) . |

* cited by examiner

*Primary Examiner*—Kien T. Nguyen
(74) *Attorney, Agent, or Firm*—Mallinckrodt & Mallinckrodt; Robert R. Mallinckrodt

(57) ABSTRACT

An inflatable recreational device forms a climbing structure upon which users can climb and play. The device may take the form of a representation of a mountain having bulges and indentations which serve as hand and foot holds and various handles which also act as hand and foot holds. Users can climb up and down on the device or after climbing up can slide or jump down from the device. The device can be used in water or on a surface such as the ground. The device is a generally hollow container, bag, or bladder which is inflated. Straps are secured inside the device to extend at various angles between the base, sides, and top to shape and contour the device and change the natural rounded balloon shape the device would normally take upon inflation without the various interior straps.

19 Claims, 4 Drawing Sheets

INFLATABLE RECREATIONAL DEVICE

BACKGROUND OF THE INVENTION

1. Field

Figure 1:
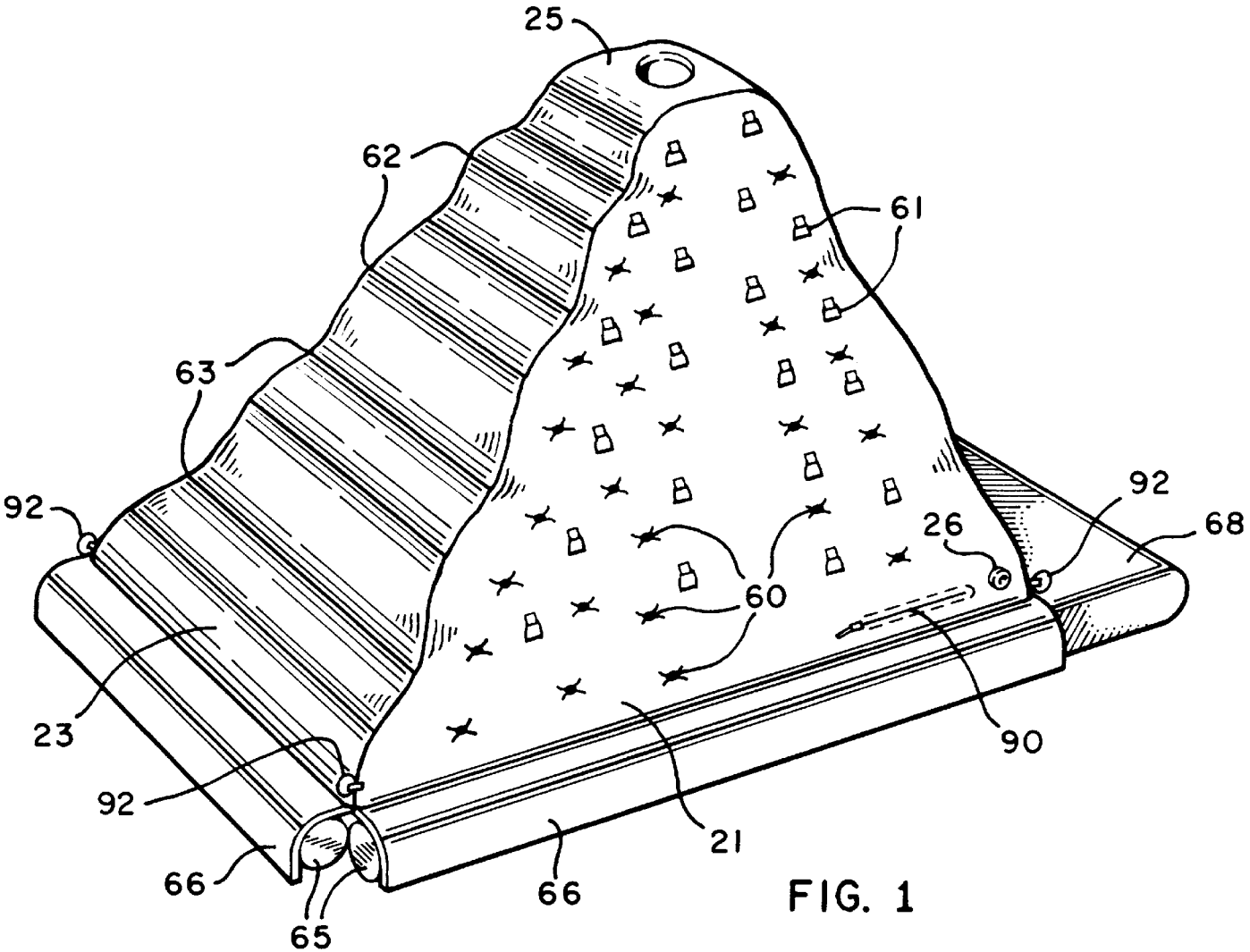

The invention is in the field of inflatable recreational devices which, when inflated, can be climbed and played upon.

2. State of the Art

There are various inflatable devices which can be used as recreational devices. For example, there are large inflatable bodies on which people, particularly children, walk or jump for amusement purposes. There are large inflatable cylinders which have hand and foot holds secured thereto so the sides of the cylinders form practice climbing walls for the practice of rock climbing. These bodies are generally formed by air impervious material forming a closed interior space that can be filled with a fluid, such as air, to inflate the body. The body takes a natural form when inflated. For example, if the material is in an elongate, relatively thin form the inflated structure will be of an air mattress or pillow form and increased inflation will cause rounding of the body, similar to a tube. A single tube would be rounded and not form a flat surface. Where relatively flat surfaces are desired, such as for air mattresses or similar inflatable structures, the body may include a series of baffles or tubes attached to opposite sides of the body to tie the opposite sides together to create relatively flat sides to the structure. If more than one baffle or tube is used, the baffles or tubes are arranged parallel to one another.

Many of the large inflated bodies, such as the walking and jumping surfaces, are inflated on a continuous basis by a blower continually supplying air to the interior of the body. This means that the body has to be connected by a hose to the blower, and the blower has to be connected to a source of power. This limits the positioning of the body and causes some safety problems with wires extending to the blower and hoses extending from the blower to the body.

SUMMARY OF THE INVENTION

According to the invention, an inflatable recreational device, such as an inflatable climbing mountain, includes a gas tight, flexible body having an interior to be filled with an inflating fluid, such as air. A valve communicating with the interior of the body allows gas to flow to or from the body when the valve is open and to seal the body when the valve is closed. Several valves or other auxiliary sealable openings may be provided to allow more fluid flow to the body during inflation to reduce inflation time.

A plurality of connecting means in the interior of the body interconnect portions of the body to one another to shape the body when inflated thereby modifying the shape of the body over the shape that it would otherwise take when inflated. At least some of the connecting means are nonparallel to other of the connecting means and extend at various angles to various parts of the body to create the desired shape. Thus, where the device takes the form of a climbing mountain, the connecting means shape the mountain to provide a mountain shape rather than the rounded balloon shape that an inflated body would otherwise take. The connecting means can also create indentations in the inflated body where desired to provide climbing holds for hands or feet or for other desired purposes. Hand and foot holds can also be attached and generally will be attached to the surface of the device, if and where desired to assist the user in climbing the device.

The device will generally include at least one generally or substantially flat side which can form the bottom of the device, such as the bottom of a mountain shape which forms a surface upon which the device can rest on the ground or a floor, or upon which the device can float in a body of water. A generally or substantially flat surface includes a surface with bulges and indetations such that the surface is generally flat when taken as a whole. The substantially flat side can also form the top of the device where people can assemble and play on the device such as by tilting it back and forth if a rounded side is on the ground or floor, or is supporting the device in a body of water.

Where a substantially flat side is formed, connecting means will be arranged inside the device in a manner to hold the desired side substantially flat. This will usually involve providing more connections for the connecting means to that side than to other sides of the body. The connecting means will extend from such side to various other portions of the body.

It has been found that connecting means can be positioned in the device by securing D-rings to the inside surface of the body at various locations, such as by a glue mount, with the connecting means in the form of straps or webbing, being secured between pairs of D-rings. Several of the straps can be secured to a single D-ring. Ends of the straps can also be directly secured to the inside surfaces of the body, or secured in a variety of other ways.

THE DRAWINGS

Figure 2:
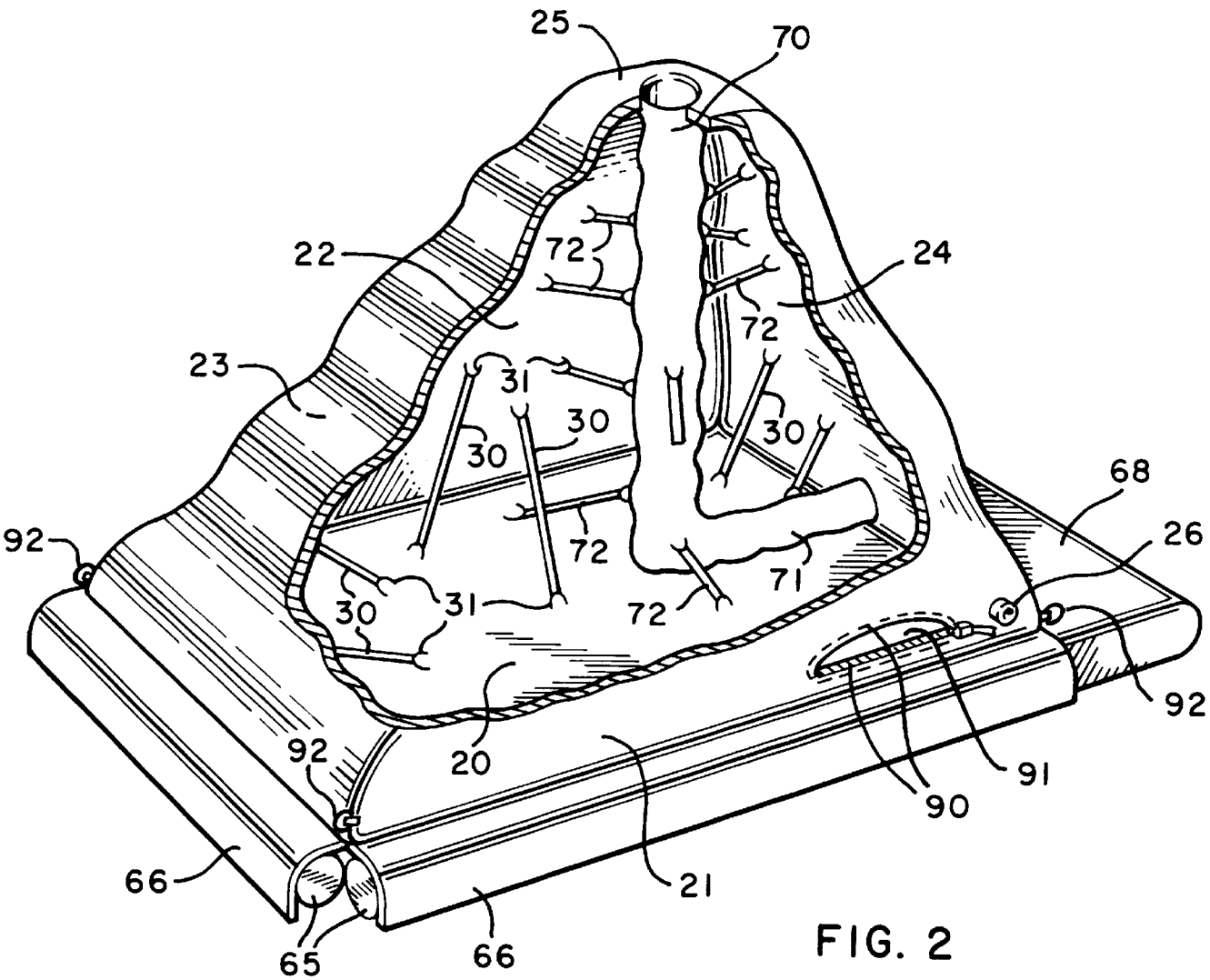
Figure 3:
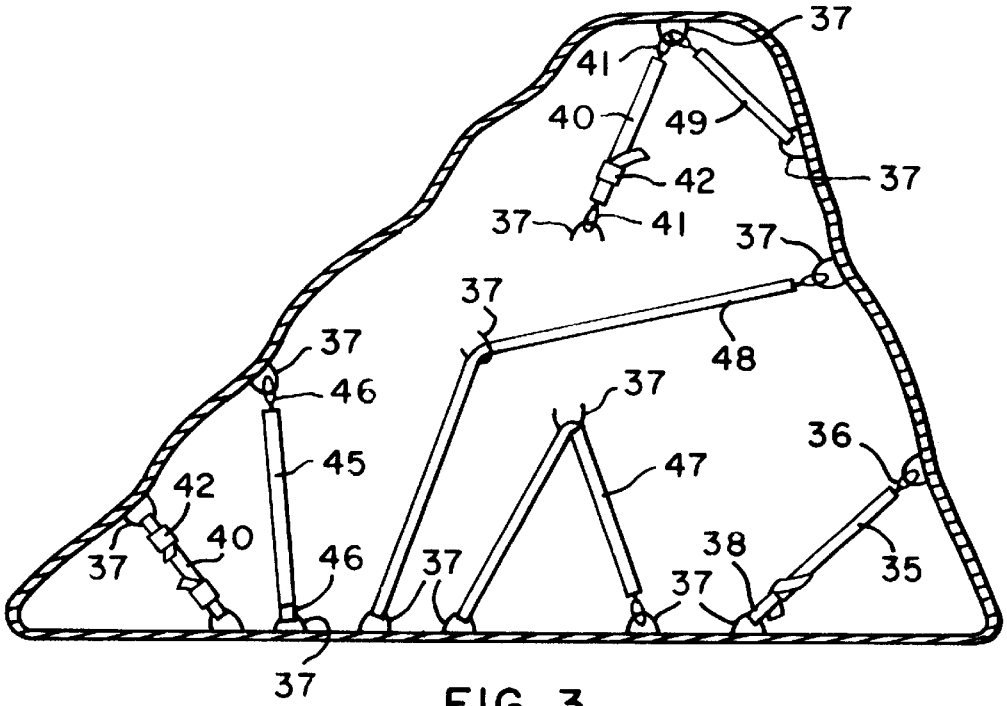
Figure 5:
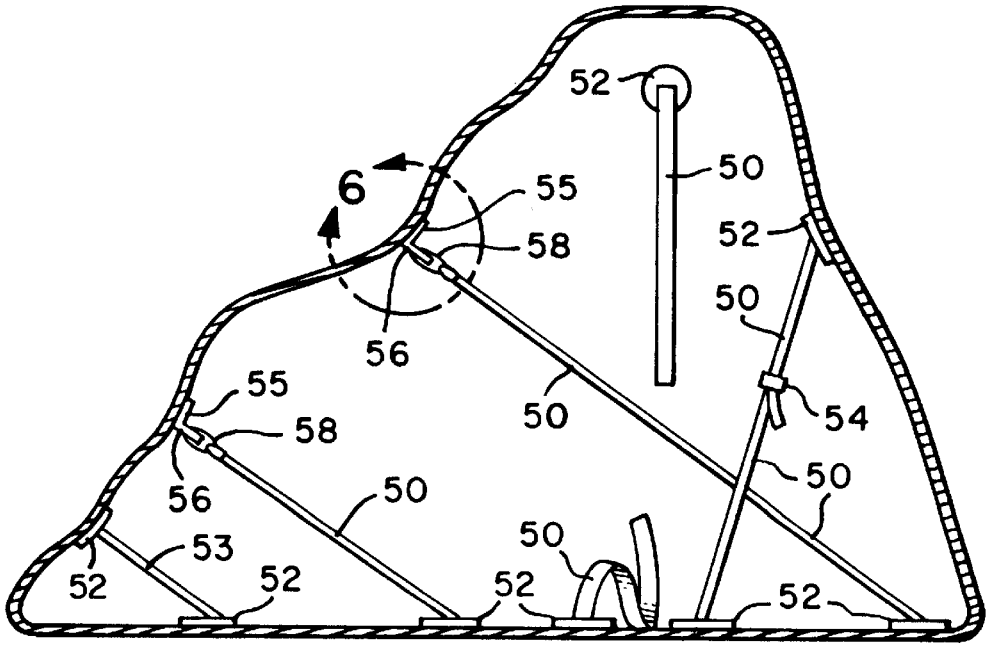
Figure 4:
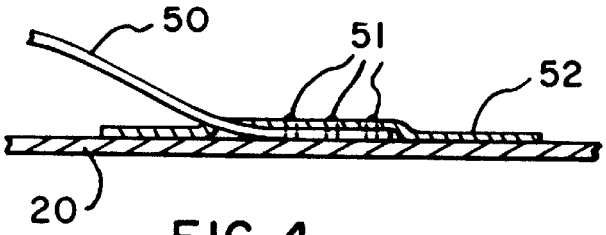
Figure 6:
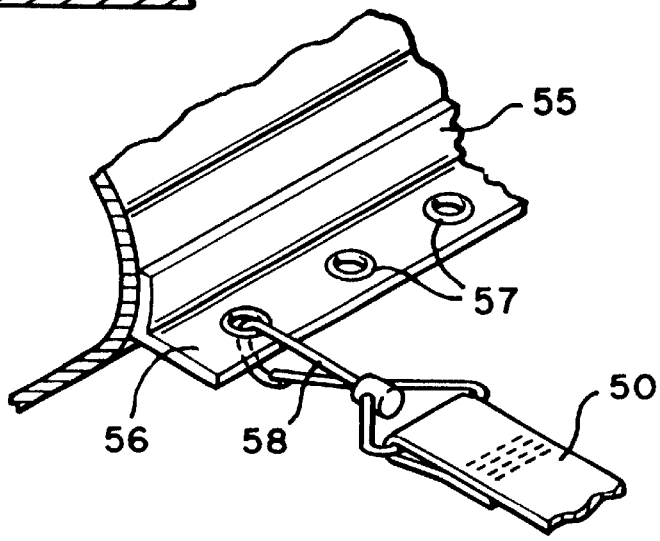
Figure 7:
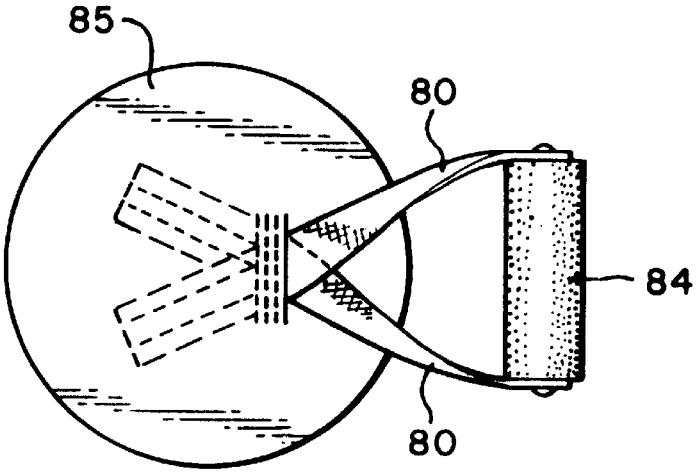
Figure 8:
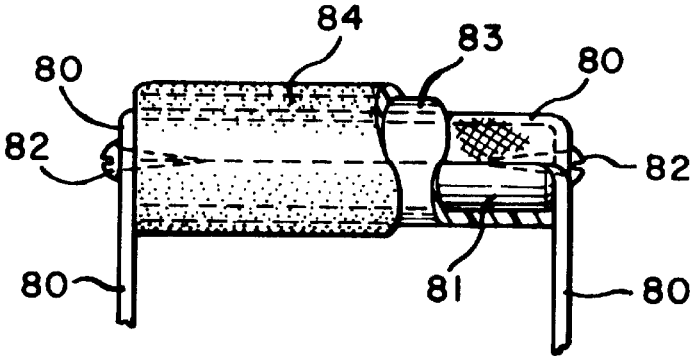

The best mode presently contemplated for carrying out the invention is illustrated in the accompanying drawings, in which:

FIG. 1 is a pictorial view of a climbing device of the invention;

FIG. 2, a view similar to that of FIG. 1, but with a portion of one side broken away to show the interior of the device;

FIG. 3, a vertical section through a device of the invention showing various alternative strap arrangements;

FIG. 4, a side elevation of a securement means for an end of a strap;

FIG. 5, a vertical section through a device of the invention showing various further alternative strap arrangements;

FIG. 6, a fragmentary perspective view of one of the securements shown in FIG. 5;

FIG. 7, a pictorial view of a handle satisfactory for use with the device of the invention; and FIG. 8, a cutaway view of a portion of the handle of FIG. 4.

DETAILED DESCRIPTION OF THE ILLUSTRATED EMBODIMENTS

In a preferred embodiment, the inflatable recreational device of the invention takes the form of a simulation of a mountain which can be climbed and played upon by users. Various mountain shapes can be formed such as the shape shown in FIG. 1. Typically a device as shown in FIG. 1 will have, for example only, a base approximately twenty-two feet by approximately fifteen feet, and have a height of approximately fourteen feet. However, various sizes can be used and a smaller version of the device can have a base of approximately twelve feet by approximately eight feet and a height of approximately eight feet. The device can be used on a surface such as the ground, or may be used in a body of water wherein the device floats in the water.

In the embodiment shown, the device has a substantially rectangular base 20 with sides 21, 22, 23, and 24 sloping upwardly therefrom to a top surface 25. The device is made of fluid impervious material, such as material used in inflatable boats or aircraft evacuation slides, and is inflated with a fluid, normally air. One or more inflation openings and valves 26 are provided so the device can be inflated and then sealed in order to remain inflated during use.

When a flexible, inflatable container, the inflatable device can be considered a flexible fluid-holding container, is inflated, it will tend to bulge like a balloon. In order to contour the device, a plurality of connecting means in the form of straps or belts 30 are arranged inside the device connecting various walls to the bottom and to one another. Various D-rings (secured to the inside of the device in normal manner such as by gluing material attached to the D-ring to the device material, referred to herein as glue mounting) or other connectors 31 are secured at various locations in the bottom, walls, and top of the device, and the straps 30 are stretched between various D-rings and tightened as desired to provide the desired contour of the device.

In contrast to currently manufactured inflatable devices such as air matresses which include tubes or baffles to flatten a side of the inflatable device, and in which such tubes or baffles are all arranged substantially parallel to one another, the straps 30 extend at various angles to one another. The number of D-rings and the number of straps shown in FIG. 2 are merely illustrative of the concept of the straps extending at various angles to one another as many more straps and D-rings would be present. The device can be individually finely configured or contoured in a creative way by a person adjusting the securement and length of each strap to make the form desired, or, if standardized, straps of predetermined length with clips on the ends can merely be keyed to particular D-rings and assembled in a mechanical way as opposed to the creative way. To adjust the strap, a strap 35 may have a clip 36 at one end attached to a D-ring 37 and manually tied as at 38 to a second D-ring 37. Alternatively, a strap 40 can have clips 41 at both ends, but have an adjustable length through adjustment of the strap passing through buckle 42. For mechanical assembly, a fixed length strap 45 may have buckles 46 at opposite ends to be attached to selected D-rings 37. In addition, a single strap, such as straps 47 and 48, may be connected at one end to a D-ring 37, pass through one or more other D-rings, and then be connected to another D-ring. Further, several straps, such as one end of each of straps 40 and 49 can be secured to the same D-ring, with the other ends of such straps extending to different D-rings at different locations in the device. Generally, more straps will be attached to the substantially flat bottom of the device to hold the flat shape than will be attached to or between other sides which have varying contours. D-rings can be secured to the bottom of the device in a regular pattern such as in a grid formation spaced, for example, every two or three feet apart. The sides can have a similar arrangement or design or may have different or a specifically designed or random pattern of D-rings. With a pattern of D-rings, not all rings need to be used.

Alternatively, rather than using D-rings, the ends of a strap can be permanently secured to the base, walls, and top of the device. For example, the ends of strap 50, FIG. 4, can be stitched as at 51 to or otherwise secured to a piece of material 52 that can be glued to the material of the device. The material 52 is glued to the base, walls, or top in desired patterns or locations. For a standardized construction, both ends of predetermined length straps 53, FIG. 5, are secured in preset locations to base, walls, and/or top. For adjustable assembly, only one end of each strap 50, FIG. 5, is permanently secured to the base, a wall, or the top and the ends of the straps are interconnected by a buckle 54, by tying, or by other means to form and adjust the connecting and contouring straps.

Rather than individual points of connection to the base, walls, or top of the device, such as separate D-rings or permanent connections, a line connection, which may be desirable for forming elongate ridges, valleys, or indentations, can be formed by securing, such as by gluing, a length of material 55 along the line to be secured. The length of material includes a flap 56 which may have holes with grommets 57, D-rings, or other means to attach ends of connecting straps 50 thereto, such as by clips 58 on the ends of the straps, or strap ends could be sewn or otherwise permanently secured directly to the flaps. While one strap 50 is shown, a plurality of straps 50 would connect a flap 56 along its length.

The sides of the device may have varying contours depending upon the intended use of the device. Generally the sides will each have somewhat different contours such as an easy more sloped side represented in FIG. 1 by the left-hand half of side 21 with a number of indentations 60 extending up the side and handles 61 which can be used as both handles and foot holds. A user can climb up the indentation, using the handles when and as necessary. The indentations (part of contouring) are created by the straps inside the device when tightened to the extent of pulling in the side where the strap is attached. Generally the tighter the strap, the more indentation created. Indentations are not created by all or most strap attachments, however, as the strap can be adjusted to merely hold the material in a substantially flat relationship with the surrounding material, or even allow it to bulge outwardly some, but not to the extent it would bulge otherwise. A harder side, represented in FIG. 1 by the right-hand half of side 21 would generally, although not shown here, be steeper and with less indentations or less pronounced indentations so that handles 61 have to be used to climb the side, such handles being used for both hand holds and foot holds. A side or portion of a side may be contoured to form a slide for users to slide down from the top of the device. The slide may be relatively flat, smooth, and straight, or may have bumps so the user can bounce from bump to bump. Such a side is represented in FIG. 1 by side 23 which includes various ridges 62 and valleys 63 creating bumps over which a user can slide on the way down. Such ridges and valleys can be formed as shown for the line connection in FIGS. 5 and 6. Alternatively, the ridges and valleys, depending upon their contour, can create an easy side for climbing up the mountain of the device as they can create somewhat of a staircase. As can be seen, a wide variety of contours and features can be provided and can vary widely from device to device or from side to side of a device. Various flattened areas can be formed at various locations on the device upon which a user can stand and then jump or dive into the water, if used in water.

The device can include tubular side extensions 65 along the bottom of one or more sides, which form auxiliary side ledges for the device and which, when the device is floating in water, provide a stabilizing effect to the device. When used on a surface such as the ground, such ledges provide a softer or giving edge to the device. The extensions may be inflated elongate tubular bodies which extend lengthwise along a side of the device. A cover 66 secured along the edge of the device adjacent the tube 65 extends over tube 65 to prevent a foot from getting stuck between the tube and the device. A tube 65 may be provided on a single side of the device, or on any number of sides. Generally, when the device is used in water, a tube will not be used at the bottom of the slide into the water, or if used, cover 66 will be positioned to form an extension of the slide into the water. Additional tubes could be used to support a more gradual extension of the slide into the water, if desired. A tube preferably would not be used on the more difficult climbing side of the device so a user would have to climb, using the hand holds, out of the water and up the side of the device. A tube provides a starting ledge for climbing, so would generally be used on the easy side.

If desired, a platform 68, usually an inflatable platform, may be secured to one or more sides of the device. The platform can provide a resting and sunbathing place alongside the device and a starting point for climbing the device. It is also a place where parents can stand to watch or help their children play on the device. Several devices of the invention can be secured together with a platform 68 between them. When used on the ground, platform 68, which may provide an inflated soft shock-absorbing surface can serve as a safety device for people sliding down the device or as a landing area for people jumping from the device.

If desired, one or more open climbing tubes or chimneys can be positioned inside the device to allow a user to crawl into the tube and climb vertically up the tube. The tube as shown in FIGS. 1 and 2, has a vertical portion 70 and horizontal portion 71. The vertical portion 70 of the tube is secured to and opens in the top wall 25 of the device and at the bottom connects with horizontal tube portion 71 which extends to and opens into a side, here side 24, of the device. The horizontal tube may be secured along one edge to the bottom 20 of the device to anchor and stabilize such tube. Since the sides of a tube such as shown would bulge inwardly and in many cases close off the tube when the device is inflated, straps 72 also have to be connected to the tube and extend to the sides and bottom of the device to contour and hold the tube open. As shown in FIG. 2, the inward bulging and contouring of the tube will provide various body, hand, and foot holds so a user can, by sliding his back along one side of the tube and using his or her hands and feet along the other side, climb up the tube. A tube of normal diameter of about two feet has been found satisfactory for the horizontal portion 71 of the tube while a normal diameter of about forty inches for the vertical portion 70 of the tube has been found satisfactory for climbing. These dimensions are merely examples and various dimensions can be used. Normal diameter is the diameter before any inward bulging of the tube caused by inflation of the device. Hand and foot holds such as shown for the exterior of the device, could be used in the tube, if desired.

While the climbing tube 70 is shown as being vertical, it could be placed at an angle or have various bends therein, as desired. Further, horizontal tube 71 can be supported above the base of the device.

Various handles can be used with the device. Generally, the handle should be useable not only as a hand hold, but also as a foot hold. A satisfactory handle can be formed using a length of nylon webbing material 80, FIGS. 7 and 8, with a central portion placed along a side of a wooden dowel 81. The webbing 80 is secured to the ends of the dowel 81 such as by screws 82. A plastic hose 83 is positioned over the webbing and dowel to hold the webbing in place, and a foam cushioning material 84 is placed over hose 83. The ends of webbing 80 are glued and stitched to disc 85 of flexible material, generally the same material from which the device to which the handles are to be attached are made, and the disc is glued to the device. If tubular webbing is used, the dowel 81 or similar item is placed inside the tubular webbing. In such case, screw 82 or other attachment means is not necessary.

In manufacture of the device, a seam of the device would be left open, the device partially filled with air on a continuous basis by a high volume or capacity blower blowing air into the device, and the various straps positioned, connected, and adjusted to form the desired device contour. The seam can then be sealed. Thereafter, the device is inflated or deflated through openings or valves 26. Several openings can be provided so the device can initially be filled relatively rapidly with several high capacity blowers through the several openings. When almost fully inflated, the openings are sealed and further inflation takes place more slowly through a valve which, when the device is fully inflated, is closed to seal the device in inflated condition.

It has been found advantageous to be able to open the device to the extent that a person can climb inside the device to adjust the straps, if necessary, or to repair the material from which the device is made if it acquires a leak. Leak repair generally should be more effective if done from the inside where the contained pressure usually is. For this purpose, an openable sealing means, such as a gas tight zipper 90 which is currently commercially available as the TIZIP from TITEX Vertriebs-GmbH of Heilsbronn, Germany, can be included in a wall of the device as shown in FIGS. 1 and 2. During manufacture, the open zipper can be used for entry into the device, and for later repairs and/or adjustment, the zipper can be opened to allow access to the interior of the device, as through the open hole 91, FIG. 2. During inflation of the device, the zipper 90 can be opened enough to allow high capacity blower air hoses to be inserted therethrough and the device mostly inflated, using such blowers and high capacity hoses. The zipper is then closed and final inflation takes place through valve 26 as described.

When used in a body of water, particularly, it will generally be desirable to tether the device in the water so it does not wash up to the shore or in a pool, about the side of the pool so users can fall or jump off onto the shore or side of the pool and become injured. Rings 92 at the corners of the device can be used to connect tethering lines to the device, with such lines extending from the sides or bottom of a pool in which the device is place or even from anchors in larger bodies of water.

While the device is normally positioned in the water or on a surface with the substantially flat base on the bottom, the device, especially the smaller version of the device, can be positioned with the base on top forming a surface upon which users can gather and rock the device back and forth.

The device as shown can serve as a base to attach additional slides of various angles and difficulties, and such slides may be inflatable and be similar to aircraft safety slides. Such slides can be attached to the top of the device or at various other locations. Similarly, various obsticals such as cones or ledges can be secured to the device which will cause a climber to maneuver around such obsticals and increase the difficulty of a climb. Further, special climbing surfaces such as a surface made according to my copending patent application Ser. No. 09/451,255 or other special climbing devices or aids may be secured to a surface of the device.

Several of the devices of the invention can be connected together in side-by-side relationship, either directly, or with platforms therebetween. Further, while a device of the invention will itself float in water, the device could be mounted on a separate base in the water, if desired.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. An inflatable recreational device, comprising:

a fluid tight, flexible body having an interior to be filled with an inflating fluid and an exterior configured to be climbed and played upon;

a valve communicating with the interior of the body to allow fluid to flow to or from the body when the valve is open and to seal the body when the valve is closed; and a plurality of connecting means in the interior of the body interconnecting portions of the body to one another to shape the body when inflated thereby modifying the shape of the body over the shape that it would otherwise take when inflated, at least some of said plurality of connecting means being nonparallel to other connecting means.

2. An inflatable recreational device according to claim 1, wherein the connecting means include securing means attached to the interior of the body at various locations, and straps extending between and connecting selected securing means.

3. An inflatable recreational device according to claim 2, wherein the securing means are D-rings glue mounted to the body.

4. An inflatable recreational device according to claim 3, wherein the straps adjustably connect selected D-rings.

5. An inflatable recreational device according to claim 2, wherein the straps have opposite ends and the securing means secure opposite ends of the straps to the body.

6. An inflatable recreational device according to claim 2, wherein the straps have opposite ends and the securing means secure at least one end of a strap to the body.

7. An inflatable recreational device according to claim 6, wherein ends of the straps not secured to the body are adjustably interconnected with other straps.

8. An inflatable recreational device according to claim 2, wherein the securing means includes an elongate strip secured to an elongate portion of the body and a plurality of straps connected to the strip.

9. An inflatable recreational device according to claim 1, additionally including openable sealing means to allow access to the interior of the device.

10. An inflatable recreational device according to claim 9, wherein the openable sealing means is a fluid tight zipper.

11. An inflatable recreational device comprising:

a fluid tight, flexible body having an interior to be filled with an inflating fluid and a top;

a valve communicating with the interior of the body to allow fluid to flow to or from the body when the valve is open and to seal the body when the valve is closed;

a plurality of connecting means in the interior of the body interconnecting portions of the body to one another to shape the body when inflated thereby modifying the shape of the body over the shape that it would otherwise take when inflated, at least some said plurality of connecting means being nonparallel to other connecting means; and a climbing tube interior to the device through which a user can climb to the top of the device.

12. An inflatable recreational device comprising:

a fluid tight, flexible body having an interior to be filled with an inflating fluid and a bottom, sides, and a top;

a valve communicating with the interior of the body to allow fluid to flow to or from the body when the valve is open and to seal the body when the valve is closed;

a plurality of connecting means in the interior of the body interconnecting portions of the body to one another to shape the body when inflated thereby modifying the shape of the body over the shape that it would otherwise take when inflated, at least some of said plurality of connecting means being nonparallel to other connecting means; and a climbing tube interior to the device through which a user can climb to the top of the device.

13. An inflatable recreational device according to claim 12, wherein the climbing tube includes a substantially vertical portion opening to the top of the device, and a substantially horizontal portion opening to a side of the device and joined to the vertical portion.

14. An inflatable recreational device according to claim 13, wherein connecting means connect portions of the climbing tube to portions of the body.

15. An inflatable recreational device comprising:

a fluid tight, flexible body having an interior to be filled with an inflating fluid;

a valve communicating with the interior of the body to allow fluid to flow to or from the body when the valve is open and to seal the body when the valve is closed;

a plurality of connecting means in the interior of the body interconnecting portions of the body to one another to shape the body when inflated thereby modifying the shape of the body over the shape that it would otherwise take when inflated, at least some of said plurality of connecting means being nonparallel to other connecting means; and auxiliary side ledges attached to selected sides of the device.

16. An inflatable recreational device according to claim 15, wherein the auxiliary side ledges are inflatable tubes.

17. An inflatable recreational device according to claim 16, additionally including a flap secured to a side adjacent the tube to cover the tube and any space between the side and the tube.

18. An inflatable recreational device comprising:

a fluid tight, flexible body having an interior to be filled with an inflating fluid;

a valve communicating with the interior of the body to allow fluid to flow to or from the body when the valve is open and to seal the body when the valve is closed;

a plurality of connecting means in the interior of the body interconnecting portions of the body to one another to shape the body when inflated thereby modifying the shape of the body over the shape that it would otherwise take when inflated, at least some of said plurality of connecting means being nonparallel to other connecting means; and a platform attached to a selected side of the device.

19. An inflatable recreational device according to claim 18, wherein the platform forms a safety landing surface if a user falls or jumps from the device.

* * * * *